US005725445A

United States Patent [19]

Kennedy et al.

[11] Patent Number: 5,725,445

[45] Date of Patent: Mar. 10, 1998

[54] FLASHING LIGHT PNEUMATIC PLAYBALL

[76] Inventors: Melvin Kennedy; Susan Matsumoto, both of 825 Marbella La., Lantana, Fla. 33462

[21] Appl. No.: 808,179

[22] Filed: Feb. 28, 1997

[51] Int. Cl.[6] ..... A63B 43/06

[52] U.S. Cl. ..... 473/570

[58] Field of Search ..... 473/570, 571, 473/593, 595, 599, 603, 604, 609, 610, 611; 273/DIG. 20

[56] References Cited

U.S. PATENT DOCUMENTS

| | | | |
|---|---|---|---|
| 2,849,819 | 9/1958 | Murphy et al. | 473/570 |
| 2,903,820 | 9/1959 | Bodell | 473/570 |
| 3,304,651 | 2/1967 | Deyerl | 473/570 |
| 3,580,575 | 5/1971 | Speeth | 473/570 |
| 5,313,187 | 5/1994 | Choi et al. | 340/331 |
| 5,456,032 | 10/1995 | Matsumoto et al. | 40/636 |
| 5,609,411 | 3/1997 | Wang | 473/571 |
| 5,639,076 | 6/1997 | Cmiel et al. | 473/570 |

*Primary Examiner*—Steven B. Wong
*Attorney, Agent, or Firm*—Michael Ebert

[57] ABSTRACT

A pneumatic playball which emits a series of strobe-like light flashes each time the ball is bounced by a player. The playball includes a spherical casing formed of flexible, translucent plastic material having internal plugs at the opposing poles of the sphere. Suspended between the polar plugs along the diametrical axis of the spherical casing is a light-flashing unit. The unit includes at least one light-emitting diode (LED) connected to a battery through an electronic blinker which each time it is activated, yields a series of voltage pulses which is applied to the LED to produce a series of light flashes. Activation of the blinker is effected by a motion sensing switch which closes to activate the blinker only when the ball is bounced or otherwise undergoes an abrupt change in velocity.

10 Claims, 2 Drawing Sheets

FLASHING LIGHT PNEUMATIC PLAYBALL

BACKGROUND OF INVENTION

1. Field of Invention

This invention relates generally to flashing light displays created by light-emitting diodes, and more particularly to a pneumatic playball having a light flashing unit disposed within a translucent casing which when the ball is bounced by a player then emits a series of strobe-like light flashes.

2. Status of Prior Art

A light-emitting diode (LED) is a rectifying semiconductor which converts electrical energy applied thereto to light whose color depends on the material from which the diode is made. Thus when a low voltage is applied to a gallium arsenide LED, a green color is produced, whereas a gallium arsenide phosphate LED produces a red color. And a silicon carbide LED produces a yellow color.

The use of LED's to create decorative light patterns is well known. Thus bracelets and other ornamental articles are known in which LEDs mounted in an array are selectively activated by means of an electronic switching circuit connected to a D-C power source, the resultant light pattern depending on which LEDs in the array are simultaneously activated.

A strobe light uses a gas-discharge flashtube to produce brief, intense flashes of light for high speed illumination, as in photography. In a flashing light pneumatic playball in accordance with the invention, an LED light flashing unit is intermittently activated to emit brief flashes of light in the manner of a flashtube whereby the unit produces strobe-like light effects.

Of prior art interest is the 1995 Matsumoto and Kennedy U.S. Pat. No. 5,456,032 which discloses a self-sufficient, blinking-light LED device formed by a decoratively-shaped casing having a LED projecting from its face. The casing is attachable to the shoe of an individual or elsewhere on his person whereby as the individual walks or jogs, the resultant changes in velocity cause the LED to be intermittently activated to create strobe-like light effects which attract attention.

Housed in the casing is a D-C power source connected through an acceleration-sensitive make-and-break switch to the short leads of the LED, one of which forms the fixed contact of the switch. The movable contact is defined by a cantilevered flat spring having a weight attached to its free end. A change in velocity causes the spring contact to flex to momentarily engage the fixed contact to close the switch and activate the LED.

Also of prior art interest is the 1994 Choi et al. U.S. Pat. No. 5,313,187. This patent discloses superluminescent LED's driven by a low-frequency oscillator to produce light-flashes at a frequency of 3 to 12 pulses per second. These light flashes have high on-off contrast for enhanced visibility and perceptibility at a distance. This LED arrangement is intended to serve as a battery-powered flashing-light warning device, such as in a bicycle.

SUMMARY OF INVENTION

The main object of this invention is to provide a pneumatic playball which incorporates an LED light-flashing unit whereby each time the ball is bounced by a player, a series of intense light flashes is emitted from the ball.

Among the significant features of the invention are the following:

A. Though the pneumatic playball incorporates a light-flashing unit, its internal pressure is above atmospheric so that the ball has high bounce characteristics.

B. The light flashes emitted by the ball are of strobe-like intensity; hence these flashes are clearly visible at a distance during the day, as well as at night.

C. The light flashes originate from different sites within the ball.

D. The flashing light unit which is battery operated draws virtually no current in the absence of ball movement, current being drawn only when the ball is bounced or undergoes an abrupt change in velocity. Hence the miniature batteries included in the unit have an extended operating life.

E. The pneumatic ball, when the batteries are exhausted, remains useable as a playball.

Briefly stated, these objects are attained by a pneumatic playball which emits a series of strobe-like light flashes each time the ball is bounced by a player. The playball includes a spherical casing formed of flexible, translucent plastic material having internal plugs at the opposing poles of the sphere. Suspended between the polar plugs along the diametrical axis of the spherical casing is a light-flashing unit.

The unit includes at least one light-emitting diode (LED) connected to a battery through an electronic blinker which each time it is activated, yields a series of voltage pulses that is applied to the LED to produce a series of light flashes. Activation of the blinker is effected by a motion sensing switch which closes to activate the blinker only when the ball is bounced or otherwise undergoes an abrupt change in velocity.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

First Embodiment

Figure 1:
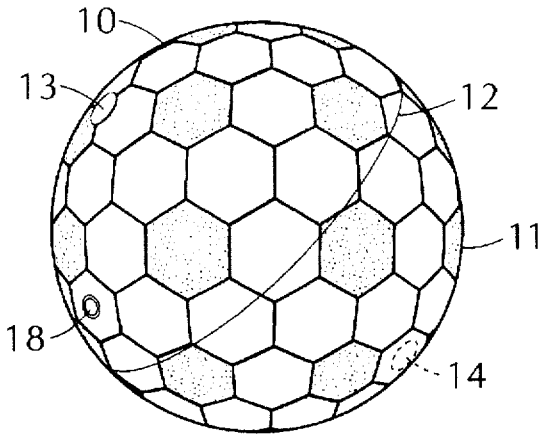
FIG. 1 shows a flashing light pneumatic playball in accordance with the invention.
Figure 2:
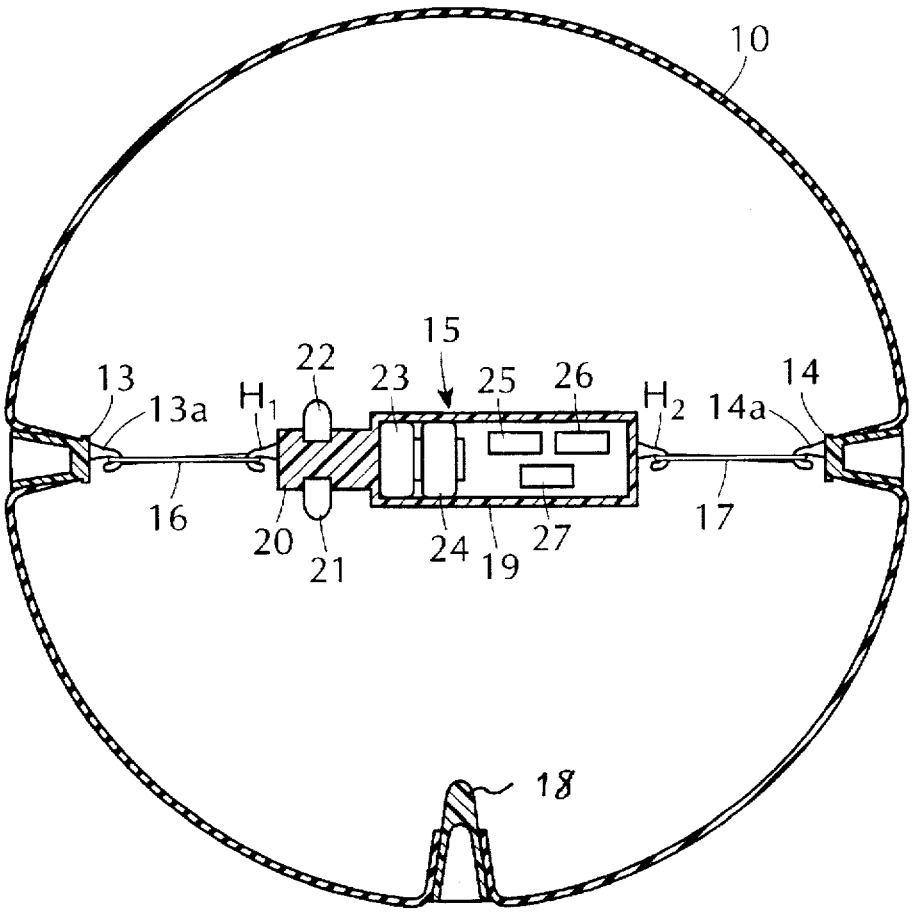
FIG. 2 is a section taken through the ball which exposes the light flashing unit incorporated in the ball.

FIGS. 1 and 2 show a flashing-light pneumatic playball in accordance with the invention whose casing is defined by a complementary pair of hemispherical shells 10 and 11 that are sealed together at a circumferential line 12 to create a sphere. The shells are molded of soft, flexible thermoplastic material, such as polyethylene or PVC.

Disposed within the spherical casing and projecting inwardly from its opposing poles are polar plugs 13 and 14 having respective hooks 13*a* and 14*a*. Suspended between polar plugs 13 and 14 along the diametrical axis of the sphere is a light flashing unit, generally identified by numeral 15. Unit 15 is provided at its opposite ends with hooks $H_1$ and $H_2$.

Unit 15 is suspended within the casing by a rubber band 16 stretched between hook 13*a* of polar plug 13 and hook $H_1$ on one end of the unit, and by a rubber band 17 stretched between hook 14*a* of polar plug 14 and hook $H_2$ on the other end of the unit. Hence flashing light unit 15 is resiliently supported in the central region of the spherical casing, and though the ball is subjected to bouncing forces, these shock forces are not damaging to the resiliently suspended unit.

Also included in spherical casing 10–11 is a fill plug 18 which projects into the casing at a position displaced from the polar plugs. The fill plug 18 is formed of rubber, neoprene or other self-sealing material. Plug 18 is injectable by a hypodermic needle coupled by a line to a source of pressurized air to raise the internal air pressure in the casing to a level above atmospheric, after which the needle is withdrawn. The fill plug serves to seal the casing to maintain it in a pressurized state.

The air-pressurized pneumatic playball formed of a soft, flexible casing is compressible and has high bounce characteristics. It is also easy for a player to handle, for his fingers, when grasping the ball, then indent it to provide a good grip.

Flashing unit 15 includes a cylindrical plastic casing 19 having a neck 20 extending from one end on which is mounted an opposing pair of LED's 21 and 22. In practice, these LED may both produce light of the same color, such as red, or produce light of contrasting colors, such as red and green.

Figure 3:
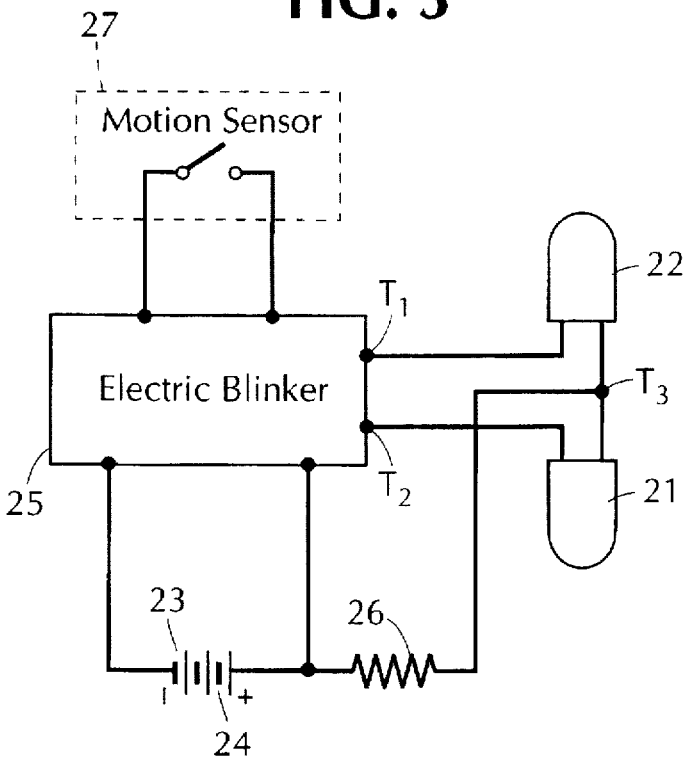
FIG. 3 is a schematic diagram of the light flashing unit.

To power the pair of LED's 21 and 22, two miniature button-shaped 1.5 volt battery cells 23 and 24 are provided, batteries being housed in casing 19 adjacent the neck thereof in series relation to provide a 3 volt output for the LED's. As shown in FIG. 3, these LED's are connected are in series relation to an electronic blinker 25 which yields voltage pulses alternately at output terminals $T_1$ and $T_2$ to alternately activate LED's 21 and 22.

Batteries 23 and 24 are connected to the LED's through electronic blinker 25 in series with a current-limiting resistor 26 which is connected to a terminal $T_3$ on a line common to both LED's. When the LED's are alternately activated, they then draw current from the battery power supply, the current flowing through the resistor results in a voltage drop that abruptly deactivates the LED's.

Hence when the electronic blinker 25 supplies a voltage pulse to the LED's to activate them briefly, the activation period is shortened by the current-limiting resistor to produce an intense flash of light, very much in the manner of a strobe flashtube.

Figure 4:
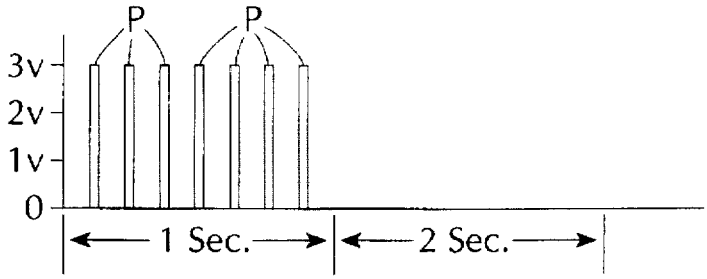
FIG. 4 shows the series of voltage pulses produced by the electronic blinker included in the unit.

Blinker 25 is an integrated circuit chip which when activated then produces a series of 5 to 10 voltage pulses per second, such as a series of pulses P shown in FIG. 4. Each pulse in the series has a duration of a few milliseconds. The flashes in the resultant series of light flashes are visually spaced from each other, for the pulse rate is below that producing visual persistence.

Electronic blinker 25 is activated by a motion sensing switch 27 which is connected to the blinker so that only when this switch is closed is the blinker activated to produce the series of voltage pulses P. Pulses P activate the LED's to produce a series of high-intensity light flashes. These light flashes are strobe-like and therefore highly visible even during daylight hours.

Motion sensing switch 27 may be of the type disclosed in the above-identified Matsumoto-Kennedy patent in which the switch takes the form of a cantilevered flat spring having a metal weight attached to its free end.

Figure 5:
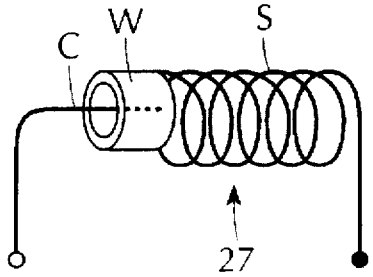
FIG. 5 shows the motion sensing switch included in the unit.

When this motion sensor switch is subjected to an abrupt change in velocity, such as a change arising when the ball containing the motion sensor is bounced, this causes the spring-supported weight to accelerate to engage a fixed wire contact and close the switch. In practice, motion sensor 27, as shown in FIG. 5, may consist of a helical spring S forming the movable contact of the switch and having a metal collar W attached to its free end, and a fixed contact wire C normally extending coaxially into the collar. When ball motion is sensed, collar W at the end of the movable contact spring S is displaced to make contact with fixed contact wire C to close the switch.

When the pneumatic ball is at rest, virtually no current is then drawn from batteries 23, 24, for motion sensing switch 27 is then open and electronic blinker 25 is inactive and draws only a minute quiescent current in the microampere range. And when playing with the ball, current is drawn only when the ball is bounced to close switch 27, in which case current is drawn only during the very brief voltage pulse yielded by the blinker. Because the LED's are on opposite sides of the light-flashing unit and are alternately activated, one looking at the ball sees light flashes originating from different sites within the ball rather than from a single site.

The amount of current in the milliampere range drawn from the batteries, even when the ball is repeatedly bounced, is relatively small and the battery therefore has a long operating life. But since the batteries are sealed within the ball and are not replaceable, when they are ultimately exhausted, the ball no longer produces light flashes. However the pneumatic ball is still in playable condition. In practice, one can use long-life miniature batteries of the type included in heart pacemakers so that the flashing unit included in the ball then possesses an exceptionally long operating life.

While there has been shown a preferred embodiment of a flashing light pneumatic playball in accordance with the invention, it is to be understood that many changes may be made therein without departing from the spirit of the invention.

I claim:

1. A pneumatic playball adapted to emit light flashes each time the ball is bounced, said playball comprising:

A: a spherical casing having diametrically opposed poles and internal plugs provided at the poles formed of flexible, translucent synthetic plastic material enclosing air having an internal pressure above atmospheric to impart bounce characteristics to the ball; and B: a light flashing unit suspended within the casing to occupy a position along a diametrical axis extending between said poles from said internal plugs and including at least one light-emitting diode (LED), a battery and a motion-sensing switch effectively coupling the battery to the LED to cause the LED to produce light flashes only when the ball is bounced to close the switch.

2. A playball as set forth in claim 1, in which the casing includes a fill plug adapted to receive a hypodermic needle to inject pressurized air into said casing.

3. A playball as set forth in claim 1, in which the unit includes a pair of LED's.

4. A playball as set forth in claim 1, in which the casing is formed by two complementary hemispherical shells which are sealed together.

5. A playball as set forth in claim 1, in which the suspension is effected by a first rubber band stretched between one end of the unit and one of the internal plugs, and a second rubber band stretched between the other end of the unit and the other of the internal plugs.

6. A playball as set forth in claim 1, in which the battery is connected to the LED through an electronic blinker which is activated only when the motion sensing switch is closed to yield a series of voltage pulses which are applied to the LED.

7. A playball as set forth in claim 6, in which the series of voltage pulses is constituted by at least five pulses per second.

8. A playball as set forth in claim 7, in which said blinker is connected to the LED through a current-limiting resistor.

9. A playball as set forth in claim 6, including a pair of LED's which are alternately activated by said electronic blinker.

10. A playball as set forth in claim 9, in which the pair of LED's are disposed on opposite sides of the light-flashing unit so that the light flashes come from different sites within the ball.

* * * * *